US008482476B2

(12) United States Patent
Yanagihara et al.

(10) Patent No.: US 8,482,476 B2
(45) Date of Patent: Jul. 9, 2013

(54) ANTENNA HAVING SPARSELY POPULATED ARRAY OF ELEMENTS

(75) Inventors: Hiromichi Yanagihara, Fukuoka (JP); Mineki Soga, Nisshin (JP); Harald Franz Arno Merkel, Lindome (SE)

(73) Assignee: Toyota Motor Europe NV/SA, Brussels (BE)

( * ) Notice: Subject to any disclaimer, the term of this patent is extended or adjusted under 35 U.S.C. 154(b) by 140 days.

(21) Appl. No.: 13/202,157

(22) PCT Filed: Oct. 21, 2010

(86) PCT No.: PCT/EP2010/065906

§ 371 (c)(1),
(2), (4) Date: Aug. 18, 2011

(87) PCT Pub. No.: WO2011/048195

PCT Pub. Date: Apr. 28, 2011

(65) Prior Publication Data

US 2011/0298676 A1 Dec. 8, 2011

(30) Foreign Application Priority Data

Oct. 22, 2009 (EP) ..... 09173715

(51) Int. Cl.
*H01Q 13/10* (2006.01)

(52) U.S. Cl.
USPC ..... 343/844; 343/711; 343/853

(58) Field of Classification Search
USPC ..... 343/711, 712, 844, 853, 893
See application file for complete search history.

(56) References Cited

U.S. PATENT DOCUMENTS

| | | | | |
|---|---|---|---|---|
| 3,130,410 | A * | 4/1964 | Gutleber | 343/844 |
| 3,811,129 | A * | 5/1974 | Holst | 343/844 |
| 4,071,848 | A | 1/1978 | Leeper | |
| 4,888,597 | A | 12/1989 | Rebiez et al. | |
| 6,031,491 | A * | 2/2000 | Daniel et al. | 343/700 MS |
| 6,243,052 | B1 * | 6/2001 | Goldstein et al. | 343/895 |
| 6,525,697 | B1 | 2/2003 | Theobold | |
| 6,992,638 | B2 * | 1/2006 | du Toit et al. | 343/776 |
| 7,696,945 | B2 * | 4/2010 | Svensson et al. | 343/844 |

FOREIGN PATENT DOCUMENTS

| | | |
|---|---|---|
| EP | 1 416 584 A1 | 5/2004 |
| FR | 2 741 478 A1 | 5/1997 |

OTHER PUBLICATIONS

L. E. Kopilovich, et al., "Two-dimensional aperiodic antenna arrays with a low sidelobe level", IEE Proceedings, Jun. 1, 1991, pp. 233-237, vol. 138, No. 3.

* cited by examiner

*Primary Examiner* — Tho G Phan
(74) *Attorney, Agent, or Firm* — Sughrue Mion, PLLC

(57) ABSTRACT

An antenna (80,90) has a one dimensional or multidimensional array of elements (20,40), wherein spacings between successive elements of at least part of the array are non periodic and correspond to a series of multiples of a unit spacing, the multiples following a Fibonacci sequence. Two dimensional arrays can be arranged as a Fibonacci grid or as a Fibonacci square tiling. The number of elements can be reduced for a given measure of resolution, while still enabling the signal being transmitted or received to have a peak in a single unique direction and thus form a beam. Furthermore, since there will be some elements clustered close together and a few which are well spaced, it can be more suitable for vehicles (30) than a regularly spaced array. It can be used as a transmit antenna or as a receive antenna for a submillimeter radar system.

20 Claims, 8 Drawing Sheets

ANTENNA HAVING SPARSELY POPULATED ARRAY OF ELEMENTS

CROSS REFERENCE TO RELATED APPLICATIONS

This application is a National Stage of International Application No. PCT/EP2010/065906 filed Oct. 21, 2010, claiming priority based on European Patent Application No. 09173715.5 filed Oct. 22, 2009, the contents of all of which are incorporated herein by reference in their entirety.

FIELD OF THE INVENTION

This invention relates to array antennas, to radar systems having such antennas, to methods of producing layouts of elements for such antennas.

BACKGROUND OF THE INVENTION

Synthetic Aperture Radar (SAR) technology involves the usage of large arrays. Each individual array element can be controlled individual in phase and amplitude. By this purpose a set of e.g. phase delays are programmed into all antenna elements and the resulting measurement value is stored for further processing. The strength of SAR methods lies in the fact that provided the set of phases has been sufficient, any kind of beam form can be synthesized afterwards i.e. reconstructing data that would have been measured by using a specific type of antenna with a specific beam pattern. SAR has been invented to allow the radar system to track a target without any mechanically moving parts and to be able to track several targets at the same time. The number of antenna elements required for a typical SAR applications ranges from 100s to 1000s for a 2D imaging system. Using microwave frequencies, a single SAR element does not cost much and the generation, transport and distribution (and collection) of microwave signal is cheap and there are a multitude of low-loss solutions for all kinds of geometries and topologies. The situation is completely different in submillimeterradars: For submillimeter radars there is no cheap and efficient way to generate signal power, there is neither a way to efficiently transport power over several hundreds of wavelengths (waveguides at these frequencies are expensive to machine and bends are difficult to produce, cables do not work and microstrip/stripline/coplanar waveguide technologies yield only good antennas and/or have high losses but they all are no good transmission lines above 100 GHz).

EP 807 990 B1 (The Boeing Cy) states that irregular arrays are known in the state of the art for providing a way to address grating lobe problems inherent in regular arrays because irregular arrays eliminate periodicities in the element locations. Random arrays are known in the state of the art as one form of irregular array. Random arrays are limited in their ability to predictably control worst case sidelobes. When the array element location can be controlled, an algorithm may be used to determine schemes for element placement that will allow for more predictable control of worst case sidelobes. Prior art contains many examples of irregularly spaced linear arrays many of which are non-redundant, that is, no spacing between any given pair of elements is repeated. Non-redundancy provides a degree of optimality in array design with respect to controlling grating lobes.

It also states that prior art for designing irregular planar arrays is largely ad-hoc. Only a few simple examples of non-redundant planar arrays—where there is either a relatively small number of elements or a simplistic element distribution such as around the perimeter of a circle—appear to exist in prior art. Prior art appears void of non-redundant planar array design techniques for locating an arbitrary number of elements distributed throughout the array aperture (as opposed to just around the perimeter) in a controlled manner to ensure non-redundancy and circular symmetry.

It goes on to propose a planar array design substantially absent of grating lobes across a broad range of frequencies where the available number of elements is substantially less than that required to construct a regular (i.e., equally spaced element) array with inter-element spacing meeting the half-wavelength criteria typically required to avoid grating lobe contamination in source maps or projected beams. This is done by providing a planar array of sensing or transmitting elements (e.g., microphones or antennas) spaced on a variety of arc lengths and radii along a set of identical logarithmic spirals, where members of the set of spirals are uniformly spaced in angle about an origin point, having lower worst-case sidelobes and better grating lobe reduction across a broad range of frequencies than arrays with uniformly distributed elements (e.g., square or rectangular grid) or random arrays. The array is circularly symmetric and when there are an odd number of spirals, the array is non-redundant. A preferred spiral specification embodiment combines the location of array elements on concentric circles forming the geometric radial center of equal-area annuli with locations on an innermost concentric circle whose radius is independently selected to enhance the performance of the array for the highest frequencies at which it will be used. The arrays may be used for phased electromagnetic antenna arrays.

US 2007075889 shows millimeter wave holographic imaging equipment arranged to operate with fewer antenna elements, thereby greatly reducing the cost. It involves synthetic imaging using electromagnetic waves that utilizes a linear array of transmitters configured to transmit electromagnetic radiation between the frequency of 200 MHz and 1 THz, and a linear array of receivers configured to receive the reflected signal from said transmitters. At least one of the receivers is configured to receive the reflected signal from three or more transmitters, and at least one transmitter is configured to transmit a signal to an object, the reflection of which will be received by at least three receivers.

SUMMARY OF THE INVENTION

An object of the invention is to provide alternative array antennas, radar systems having such antennas, methods of producing layouts of elements for such antennas, and corresponding computer programs for carrying out such methods. According to a first aspect, the invention provides:

An antenna having a one dimensional or multidimensional array of elements, wherein spacings between successive elements or groups of elements in at least part of the array are non periodic and correspond to a series of multiples of a unit spacing, the multiples for at least four or five of the elements or groups of elements following a Fibonacci sequence.

This spacing arrangement enables the number of elements to be reduced for a given measure of resolution, while still enabling the signal being transmitted or received to have a peak in a single unique direction and thus form a beam. Thus power wasted in side lobes can be kept low by using radiating elements with a considerable beam forming capability, and costs which are dependent on the number of elements can be kept low. An additional advantage is that the aperture can be filled more efficiently for a given resolution and for a given level of side lobe reduction. In principle, having a number of successive non-periodic spacings corresponding to a Fibonacci sequence increases the number of different distances between any two of the elements, for a given number of elements, compared to other spacing arrangements. The more different distances there are, the better will be the side lobe reduction. Furthermore, in principle, having a number of successive non-periodic spacings corresponding to a Fibonacci sequence can also increase the length of the antenna baseline for a given number of elements. The longer the baseline, the better is the possible resolution on the target. It follows that the number of elements needed can be reduced for a given baseline length and given level of side lobes. Particularly where each element is costly, it can be useful to reduce the number of elements and optimize each element, rather than using the conventional approach of having a large number of elements to obtain lower noise and narrower beam-shape.

Reducing the number of radiating elements allows use of more complex radiating elements. Furthermore, since there will be some elements clustered close together and a few which are well spaced, this can make it easier to find suitable locations for elements in applications where space is restricted (such as vehicles where load space or passenger space or windows must not be impeded), than would be the case for a more regularly spaced array of comparable size.

Other aspects of the invention include corresponding radar systems having such antennas for transmitting or receiving, and corresponding methods of manufacturing the antennas involving producing a layout for elements of such antennas. Embodiments of the invention can have any other features added, some such additional features are set out in dependent claims and described in more detail below. Any of the additional features can be combined together and combined with any of the aspects. Other advantages will be apparent to those skilled in the art, especially over other prior art. Numerous variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which.

DETAILED DESCRIPTION OF EMBODIMENTS

Figure 1:
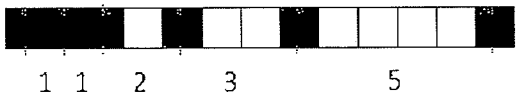
FIG. 1 shows an embodiment having antenna elements in a one dimensional array.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

The term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

References to radar can encompass passive or active systems, where active means any radar system which emits radiation to illuminate a scene and detect radiation reflected from the scene. The emitter can in principle be independent of the receiving part, if the receiving can be phase locked to the emitter, by detecting the emissions.

"Submillimeter radar" is intended to encompass generally any radar using frequencies above about 100 GHz, and examples will be described within a narrower range above 300 GHz and below 3 THz, also known as Teraherz radars. Such radars can be applied in for example systems for vehicles, and security or surveillance systems in buildings for example as is known.

References to spacings between elements is intended to encompass spacings between physical elements and spacings between mathematically synthesized elements based on regular or other physical spacings, or a mixture of such physical and synthesised elements.

References to vehicles should be interpreted broadly and can refer to any robot, robotic vehicle, self-guided vehicle, road vehicle, ship, aircraft, etc.

Introduction to Some Issues Addressed by Some of the Embodiments

Since the basic approach of a synthetic aperture is the most efficient way to collect data from a target with the ability to improve resolution "a posteriori" based on previously measured data, the crucial questions are:

With how few antenna elements can any form of SAR be still done?

What types of antenna elements are most suitable?

Where to place these antenna elements?

Generally, array antennas require a distance of the array elements to be somewhat smaller than half a wavelength in order to avoid grating lobes. Such grating lobes introduce that signals emitted using such an antenna will have several directions at which the beam is propagating mostly and when a signal is retrieved with such an antenna, there are sets of directions that cannot be separated. So for an antenna with a given spatial resolution on the target, the antenna lobe must be of the size of the dimensions to be resolved on the target. This implies that the antenna must have a certain aperture size, which can also be referred to as the length of the antenna baseline. Then the angular width of the antenna lobe is given a simple picture: Assume a point source at a distance equal to the antenna aperture size. Both sources radiate in phase. Looking in direction of the main lobe (orthogonal to the line between the both sources), both source's signals add up in direction of the main lobe. The angle in space at which the antenna lobe becomes zero for the first time is determined by the angle at which the distance difference between the observation point and the point sources becomes equal to half a wavelength.

Both requirements together yield huge numbers of antenna elements because the whole aperture must be covered with antenna elements.

But the latter point is not in fact correct, as will be explained in more detail below. The general solution to this problem will now be summarized.

As a start in solving these problems, consider the one-dimensional case. Only horizontal resolution matters for the time being. Assume a signal source placed at a distance from the receive antenna array. How can one uniquely determine where this source is? Taking a measurement at the full aperture size, the phase between the two arriving signals is read out. Note that one measures solely the remainder after an integer division by 2 Pi (360 degrees). So this one phase information yields a set of directions at which the source may be placed. Each direction is obtained by assuming an integer of full waves to be missing between the measurement antenna elements. If one combines this measurement with another one taken with two other antenna elements at a different separation distance, one can effectively exclude most of the directions if the distance between the new antenna pair is chosen to be different from the first distance. Thus all multiple direction possibilities can be excluded by having a system that is able to measure the phase distance using antenna pairs placed at all possible distances.

Choosing a minimum distance between two antenna elements (this one must be of the order of half a wavelength), one sets up the antenna elements in a irregular form along a line, where there are always a pair of antenna elements with a distance equal to any integer multiple of the minimum distance available for measurement. So this is equivalent to solving the mathematical problem of creating a measurement stick on which all possible distances can be measured with the least amount of measurement ticks painted on it.

FIG. 1, Introduction to Features of the Embodiments

For this problem there is a solution given by the Fibonacci series. A drawback is that in contrast to a usual stick the maximum measurable distance is given by the length of the stick, and Fibonacci sticks are longer than the usual stick.

The elements of the Fibonacci Series are given by a simple rule: The next element of the series is given by the sum of the two previous elements. The starting point is the series {1,1}. A first element is placed at the origin and another element in the series with a spacing distance given by the unit spacing. For the starting case, this means three antenna elements with distance 1. The next element is {1,1,2} leading to the previous antenna triple added by a fourth one at distance 2. The series with four elements is {1,1,2,3} and with five {1,1,2,3,5}. The last one allows already measurements at all distances between 1 and 12 with the exception of 9. An example of these spacings is shown in FIG. 1 for a 1 dimensional array. Single and isolated gaps do not really matter and contribute to an increase of the sidelobe noise. On the other side, only 6 elements are needed to cover an array of size 12. The sixth element yields {1,1,2,3,5,8} which allows additional values to be measured [13,16,18,19,20] (but not 9,14,15,17). It is in principle not required to apply the Fibonacci scheme on strictly successive elements but such a pure sequential Fibonacci scheme will offer the best resolution with the fewest elements. So there are alternative embodiments where the Fibonacci series is interrupted and not strictly on "successive" elements, such as where each of the Fibonacci spacings is applied to every other spacing like this: {1,1,2,1,3,1,5,1,8, 1,13 . . . }. This can be regarded as an example of the Fibonacci spacings being applied to successive groups of the elements, where the group is a pair of elements with a unit spacing, though in principle the group can be larger or have other regular or irregular spacings within the group.

Other alternative less than optimal examples can include having some of the Fibonacci spacings being moved to the other side of the initial unit spacing, for example: {8,3,1,1,2, 5,13 . . . }. Having some of the spacings elsewhere will tend to reduce the resolution efficiency calculated in number of radiating elements and less resolution at the object, since some redundancy in sets of distances between elements is introduced. References to Fibonacci spacings can also encompass other Fibonacci-like spacings that can be envisaged and which can produce some benefit in terms of increasing numbers of different distances between any two of the elements compared to regular spacings. Other examples or combinations of these examples can be envisaged, and they can be applied to the two dimensional grids or arrays described below, either in one of the two dimensions or in both dimensions.

A Fibonacci series requires two starting parameters (1 and 1 in the simplest case) and is thus only meaningful with the third element, 2, so this would be the minimum number of elements which gives a distinction between an evenly spaced and irregularly spaced array. The Fibonacci series becomes more recognizable with the fourth element 3.

In some less than optimal examples, the Fibonacci spacings can be provided for at least 50% or at least 70% of the elements. The baseline of the antenna need only be sparsely filled with radiating elements where high signal efficiency is not essential, where there is little need for SAR applications, or where it is desired to have plenty of space for each of the radiating elements, or where the cost of providing 100's or 1000's of radiating elements is prohibitive.

Embodiments can enable measurement of as much orthogonal data as possible with as few elements as possible, because the individual elements can be optimized to yield lower noise and better a priori antenna patterns. This is useful for applications where it is not possible or not practical to use multiple (e.g. >100) phase coupled elements for noise reduction.

Some embodiments of the invention have a two dimensional array having two primary axes, and the spacings corresponding to the sequence occur along at least one of the primary axes. The spacings corresponding to the sequence can occur along both of the primary axes, to give a Fibonacci grid. The unit spacing can be chosen to be a square root of 2 times a half wavelength. This enables the most sparsely populated direction to have at least half wavelength spacing and thus avoid grating lobes without reducing the unit spacing too much.

Some embodiments of the antenna can have a two dimensional array wherein the spacings corresponding to the sequence occur along a line following a spiral. This can also help avoid having directions across the array which are more sparsely populated than others. Ultimately, embodiments having the array arranged as a two dimensional Fibonacci square tiling can provide an optimal trade off between sparseness and avoiding unevenness of sparseness in different directions while having a minimal number of elements.

Other embodiments can have a one dimensional array wherein the spacings corresponding to the sequence occur along the array. Some embodiments are arranged to be suitable for use with submillimeter wavelength signals. Some have an aperture in a range of 120 mm to 1200 mm, though the effects are likely to be greater within a range of 200 to 800 mm, and some applications will suit a range of 400 mm plus or minus 50 mm. Some embodiments involve a submillimeter radar system having the antenna of any of the embodiments discussed above as a transmit antenna or as a receive antenna. The radar system can be incorporated in a vehicle.

Some embodiments involve a method of manufacturing an antenna, the method having the preliminary step of determining spacings of elements of an antenna to form a one dimensional or multidimensional array of the elements, by determining a unit spacing according to a desired wavelength, and by determining spacings between successive elements of at least part of the array to be non periodic and correspond to a series of multiples of a unit spacing, the multiples following a Fibonacci sequence.

A drawback with a Fibonacci Array is the fact that the total amount of power received from the signal compared to the filled array is lower by a factor equal to the filling factor. On the other hand, resources can be used more intelligently by improving these few receiving element to the optimum. For usual SAR radars with regular spacing of elements, the antenna elements are kept very simple with very broad element radiation lobes. In embodiments of the invention for a receive antenna one can instead use elements with reasonably narrow lobes to capture more efficiently the illumination signal since it has to be detected by only a very few antenna elements.

FIGS. 2 to 6, Antenna Response Patterns

Figure 2:
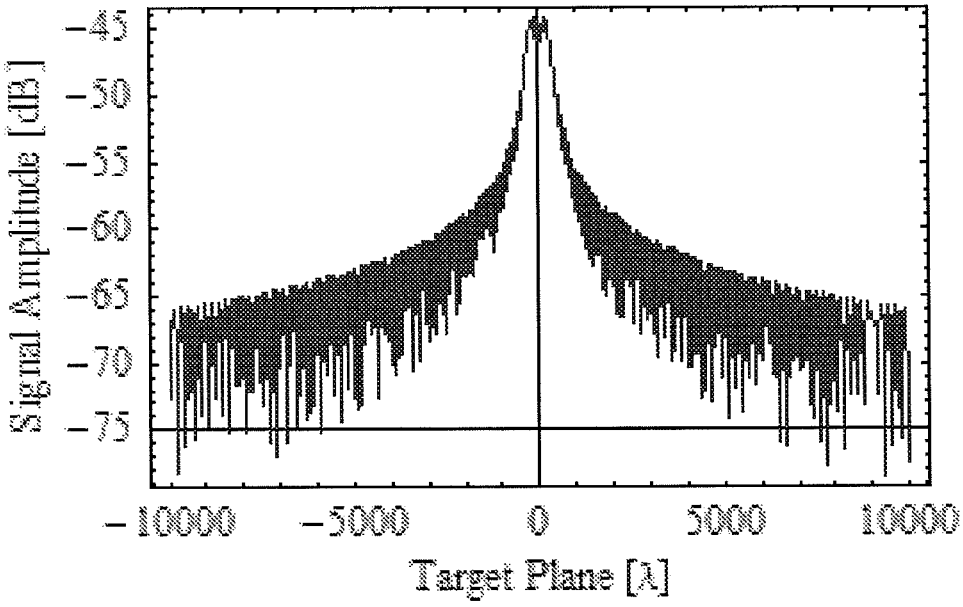
FIGS. 2 to 6 show graphs of antenna response.

Setting up a classical radar system with e.g. 400 antenna elements placed at quarter wavelength regular spacing gives a resulting antenna response pattern at a distance of 10000 wavelengths as is given in FIG. 2. This figure shows the signal strength per antenna on a target placed at 10000 wavelengths distance.

Figure 3:
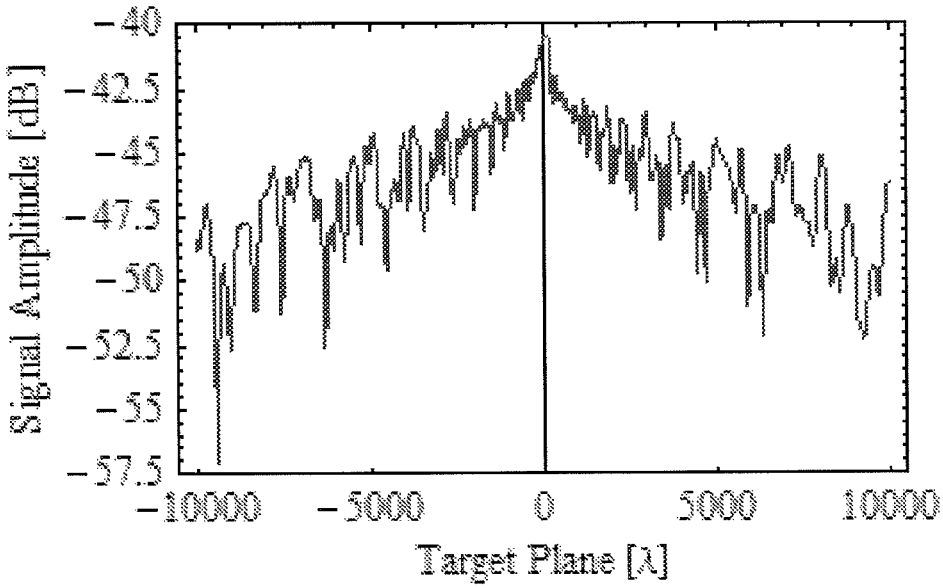

The same resolution can be reached by a Fibonacci spaced radar system with only 14 elements (instead of 400) placed at the Fibonacci distance times a unit spacing of a quarter wavelength. The resulting antenna response pattern at a distance of 10000 wavelengths as shown in FIG. 3. The physical (aperture) size of the Fibonacci radar and the classical radar are identical. The 3 dB peak width of the antenna patterns are the same in both cases.

Figure 4:
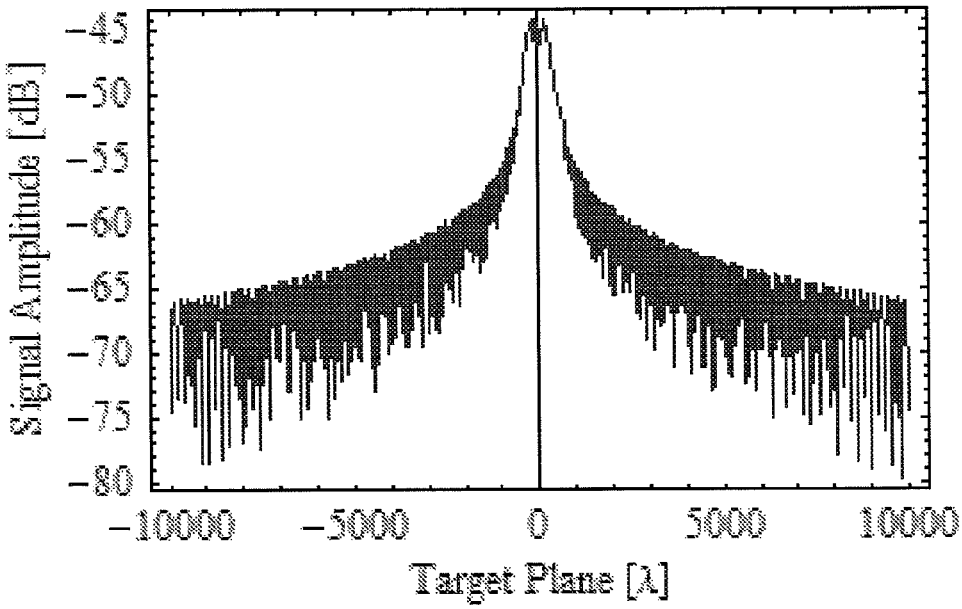
Figure 5:
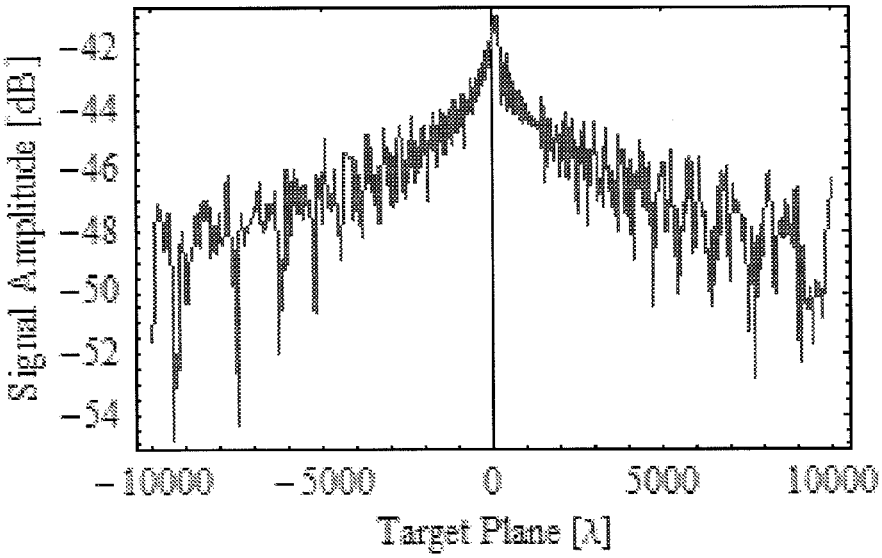
Figure 6:
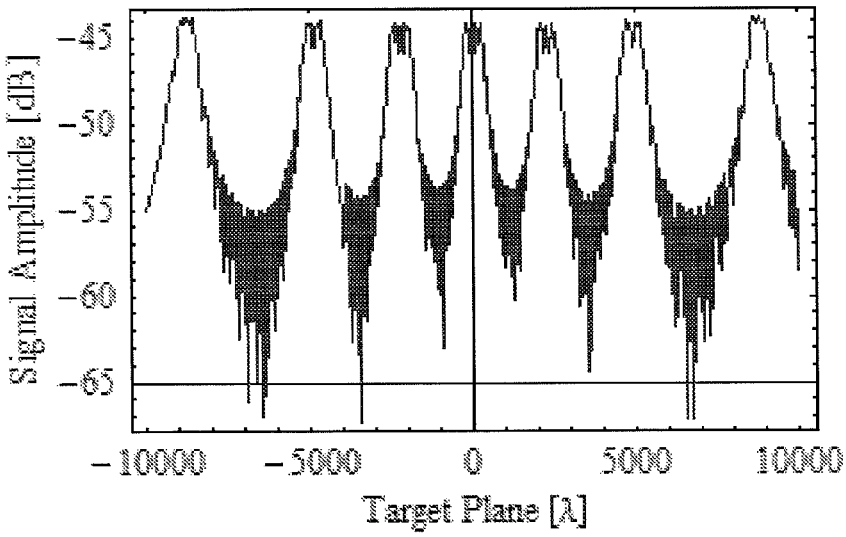

Similar Figures are obtained for a placement at a unit spacing of 0.5 wavelengths. This is the absolute maximum for a classical array placement to avoid sidelobes (c.f. FIGS. 4 and 5). FIG. 6 shows the results for a classical equidistant radar using the same number of antenna elements as the Fibonacci case for comparison.

FIG. 4 shows an antenna response pattern for equidistant spaced radar antenna elements at 0.25 wavelength distance. The Figure shows the signal strength per antenna on a target placed at 10000 wavelengths distance. The graphs are different from FIG. 2 as the conditions differ and the plots refer to the signal strength per used radiating element, not the total signal strength.

FIG. 5 shows an antenna response pattern for a Fibonacci series based antenna placement for a radar system with a base distance of 0.25 wavelength using 16 antenna elements. The Figure shows the signal strength per element on a target placed at 10000 wavelengths distance. The graph shows a single peak at the centre line.

FIG. 6 shows an antenna response pattern for an equidistant radar antenna using the same number of antenna elements as the Fibonacci system. The Figure shows the signal strength per antenna on a target placed at 10000 wavelengths distance.

Summarizing the above, it is feasible to achieve the same resolution as in a classical SAR radar with only a fraction of the number of antenna elements. The drawback is of course that the sampling area of such a radar system is proportional to the number of antenna elements used. Using a system, where sources and receivers are scarce and where the different antenna elements must be generated by beamsplitting, the efficiency of the Fibonacci system is higher than in the classical case. The LO power usage is considerably improved. But—as pointed out—signal levels are lower.

Figure 7:
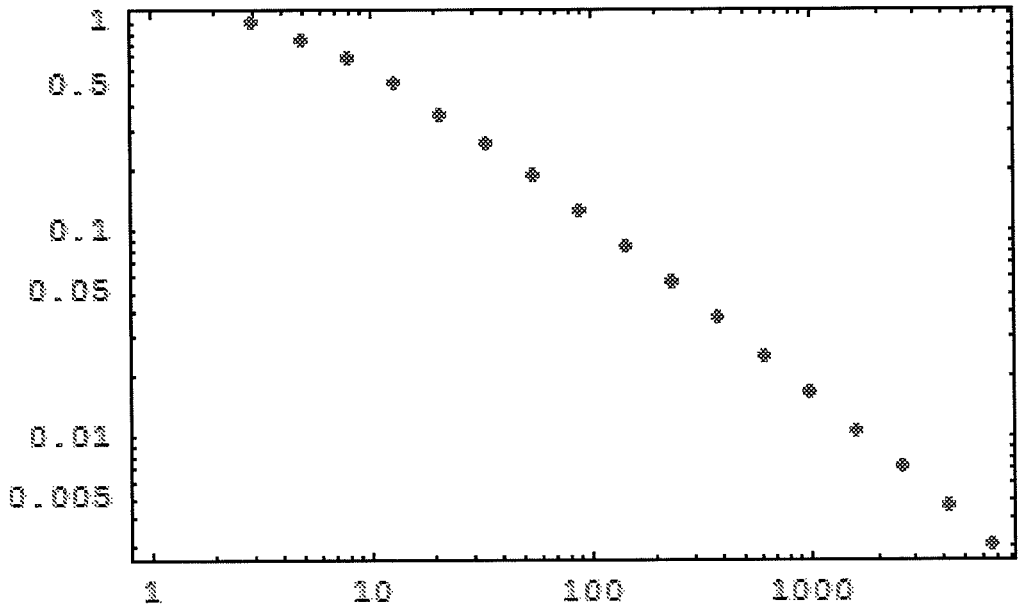
FIG. 7 shows a graph of degree of sparseness for a Fibonacci embodiment versus numbers of antenna elements in a one dimensional array.

FIG. 7, Fractions of Antenna Elements Needed

How many antenna elements can be saved in principle?

From Binet's Equation the elements of the Fibonacci series can be obtained by a closed form expression:

$$F_n = \frac{\left[\frac{\sqrt{5}-1}{2}\right]^n - \left[1 - \frac{\sqrt{5}-1}{2}\right]^n}{\sqrt{5}}$$

For a filled array of length $F_n$, $F_n$ antenna elements are needed. For the corresponding Fibonacci array, only n antenna elements are needed. Therefore the fraction of antenna elements needed as a function of the array length (in numbers of antenna elements for the filled case) is shown in FIG. 7. This shows a graph of array sparseness for a one dimensional Fibonacci antenna compared to the full populated array.

Figure 8:
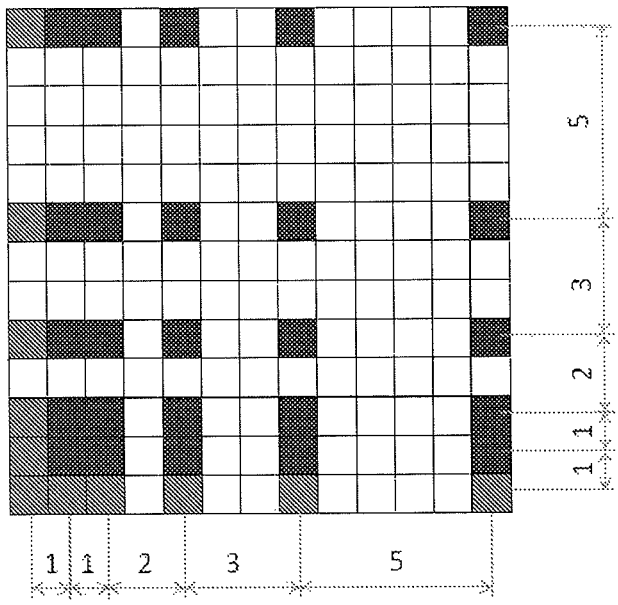
FIG. 8 shows a two dimensional Fibonacci grid.

Taking FIG. 7 and assuming a filled array with 100 antenna elements, one arrives at a sparseness of a bit less than 0.1 implying the usage of less than 10 antenna elements in a Fibonacci array. Investigating the two dimensional case, there are two solutions, a grid and a tiling as will now be explained:

FIG. 8, 2D Fibonacci Grid

This is derived by assuming a two dimensional plane where the series elements of the Fibonacci series (times a given base distance) are marked on the axes. This corresponds to the one dimensional case. Now all points where both x and y coordinate values are series elements of the Fibonacci series. This results in a scheme where a given area is populated with the product of the largest Fibonacci numbers fitting in. Such an array structure suffers some dispersion: Along a straight line that is not parallel to the coordinate axes the distances of the antenna positions close by is generally larger than on the coordinate axes. Placing the antenna elements at the maximum distance along the coordinate axes, there will be grating lobes along all distances that are more distantly populated. A Fibonacci Grid is a very good solution when the spacing between the antenna elements is chosen to be 0.707 (square root of 2) of a half wavelength. Then, even the most sparsely populated direction (being at 45 degrees) will not show grating lobes.

Such an array is shown in FIG. 8. The antenna places along the coordinate axes are shaded grey, the darker locations show additional points, where antenna elements have to be placed.

Figure 11:
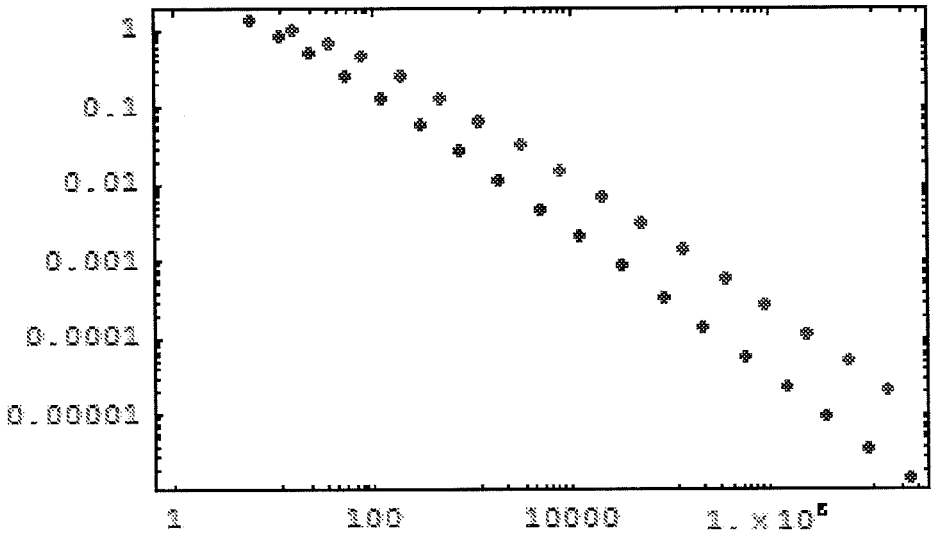
FIG. 11 shows a graph showing a degree of sparseness versus size of array.

A classical, filled 2D array of $F_n$ antenna elements along one side requires now $(F_n+1)^2$ antennas whereas the Fibonacci 2D array simply needs $(n+1)^2$ antenna elements. The savings in number of antenna elements as a function of the number of antenna elements otherwise required in a full (square) array is shown in the upper line of dots in FIG. 11.

Figure 9:
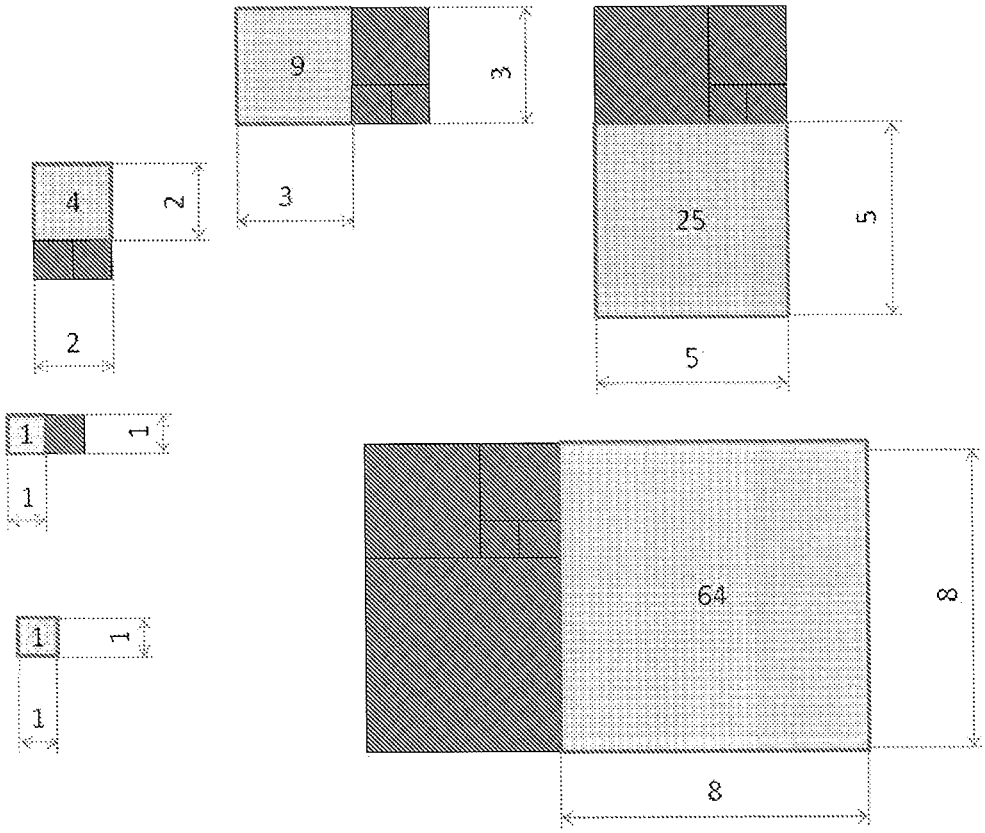
FIGS. 9 and 10 show schematic views of stages in deriving a Fibonacci square tiling.
Figure 10:
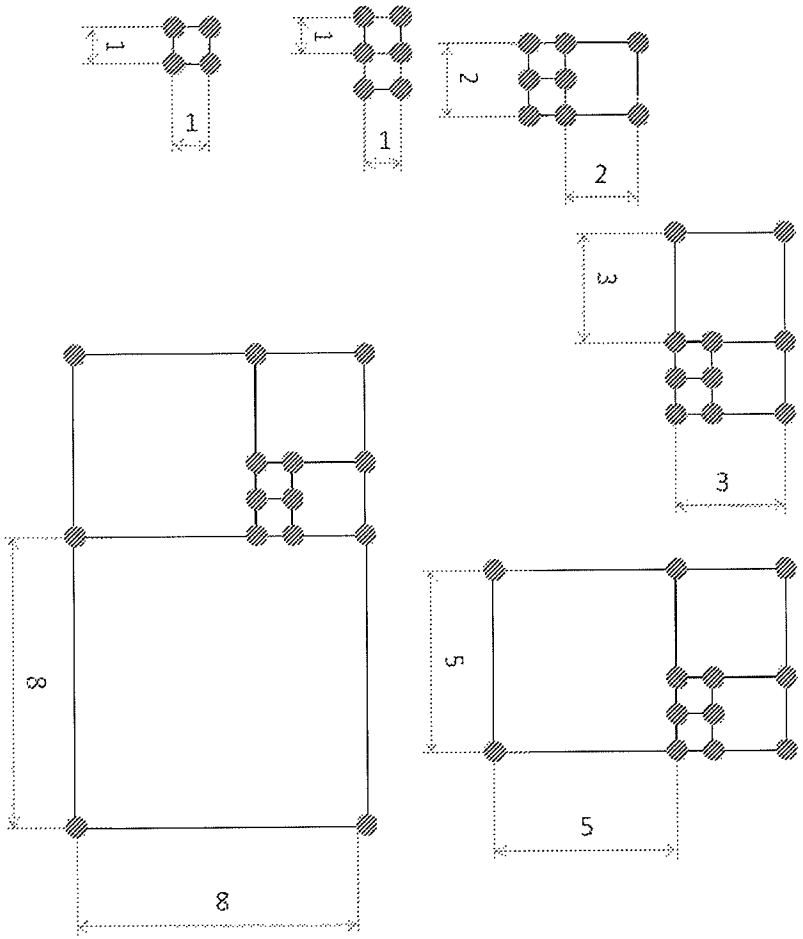

Nevertheless there is an even better way to place the antenna elements in a two dimensional case that in addition to being more economic does not show dispersion effects:

FIGS. 9 and 10, 2D Fibonacci Square Tiling

FIG. 9 shows a view of the derivation in terms of a succession of patterns generated by adding squares of different sizes. FIG. 10 shows a view of a similar succession showing antenna element positions at the corners of the squares, so that each square forms an example of a group of elements. In both cases a line joining the centres of the squares follows a spiral path. As in the case of the case of the Fibonacci 1D array, the derivation starts with the first element of the Fibonacci series (i.e. 1). Now a group of elements is arranged in a square with this unit side length at the origin where the square tiling should begin. As a next step the second group of elements is placed at a spacing corresponding to the second number in the Fibonacci series (again 1). This means placing a square with this unit side length besides the first square. A rectangle of the size 2×1 is formed. Next a square with the side length given by the third series element (i.e. 2) is placed along the rectangle's longer side. Since this longer side consists of the added length of the previously two Fibonacci elements, the element to be added will always fit in this place. The array will always be rectangular (for the n-th step, it will have a side length of $F_n$ and $F_{n-1}$).

A classical, filled 2D rectangular array of $F_n \times F_{n-1}$ antenna elements along one side requires again $(F_n+1)(F_{n-1}+1)^2$ antenna elements as in the previous case. The Fibonacci Square Tiling needs 4 antenna elements for the first step and then two more per iteration which yields 2+2n whereas the Fibonacci 2D array needs still $(n+1)^2$ antenna elements. The savings in number of antenna elements for the Fibonacci tiling as a function of the number of antenna elements otherwise required in a full (square) array is shown as the lower line of dots in FIG. 11. This shows the number of antenna elements populated as a proportion of the number of antenna elements in a filled rectangular array of the same size.

With a certain resolution requirement on the object, diffraction sets a lower limit on the size of the aperture that must be covered with emitting or receiving elements. Grating lobes should be avoided to ensure a unique direction resolution. Grating lobes occur whenever the distance between antenna elements exceeds half a wavelength. Therefore classical radar systems consist of a very large number of antenna elements filling the complete aperture surface.

For an automotive application, resolution on the object implies an aperture size in the region of 400 mm. Using a frequency exceeding 300 GHz, the wavelength is 1 mm. Therefore the classical SAR radar will have to use more than 400×400 antenna elements to meet all requirements. Being prohibitively expensive and heavy, such a system cannot be implemented on a vehicle. Using a Fibonacci tiling, the same resolution on the object can be obtained using 42 antenna elements.

In the classical system, space requirements (0.5mm distance) imply that only primitive antenna elements can be used. These antennas have a very poor antenna gain (<10 dB). Using a Fibonacci tiling, there is much more space between the antenna elements so constructively larger antenna elements can be used with antenna gains exceeding 30 dB. Using antenna elements with a gain being 35 dB larger than the SAR elements, the collected signal strength is identical to the classical filled array SAR radar.

Fibonacci 1D arrays and 2D tilings are the optimum way to collect all independent information on an aperture. There is no way to completely cover the phase and amplitude information that uses fewer antenna elements than a Fibonacci 1D array or a Fibonacci 2D tiling. The Fibonacci 2D tiling is the only 2D array that does not have dispersion (i.e. grating lobes in certain directions) when the array elements are placed at half a wavelength distances.

In a filled array, the size of the antenna elements must not exceed the antenna spacing which is about half a wavelength. Therefore only small antenna elements with poor efficiency can be used. With a Fibonacci approach only very few antenna elements are required. Therefore, the array is very sparsely populated giving space to use high efficiency antenna elements where one antenna element can be several wavelengths in size.

The savings in numbers of antenna elements is tremendous when using Fibonacci approaches. Note that these arrays have the same spatial resolution as a completely filled array. The signal collection area (i.e. the sum of the collecting size of all antenna elements) is exactly the antenna savings factor smaller compared to a SAR array. But since only a very limited number of antenna elements is needed, antenna elements with much larger collection area and higher efficiency can be used. This is especially useful for submillimeter wavelength applications, as the receiver electronics is so expensive that the number of copies needed of such electronics is the main cost driver. Thus, more elaborate antenna elements can be used with a much higher beam efficiency and create a net collecting area larger than the physical size of the filled array.

Suitable forms for the elements which can have beam forming capability at submillimeter wavelengths are e.g. horn antennas, corrugated horn antennas, microreflector antennas, or combinations of horns and dielectric lenses. Using these antenna forms, one can arrive at an optimum beam forming available for a given element size taking into account that the size of each element in a very sparse array is no longer restricted to half a wavelength. The concept resembles the VLBI (very long base line interferometry) approach in radio astronomy. There one cannot choose the position of the participating observatories and have to "get the best" out of the coherent data taken using the best possible antennas. References: for THz horn antennas see for example: http://www.virginiadiodes.com/ +ISSTT proceedings (yearly, since 1997). On VLBI see for example: http://www.evlbi.org/

Figure 12:
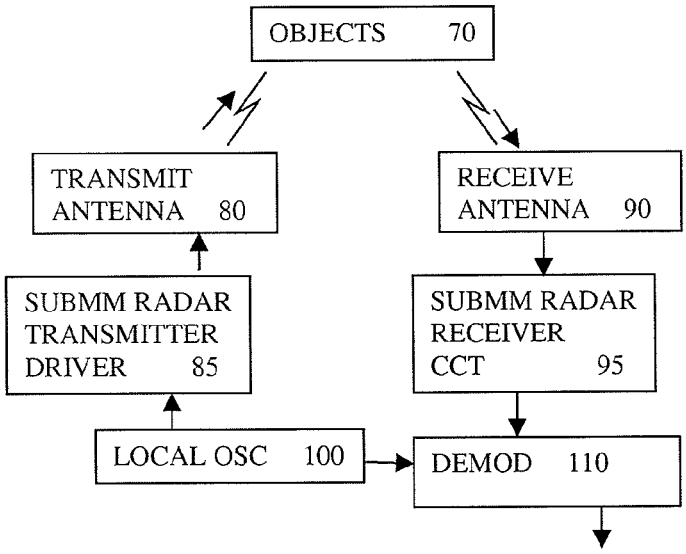
FIG. 12 shows an embodiment of a radar system.
Figure 13:
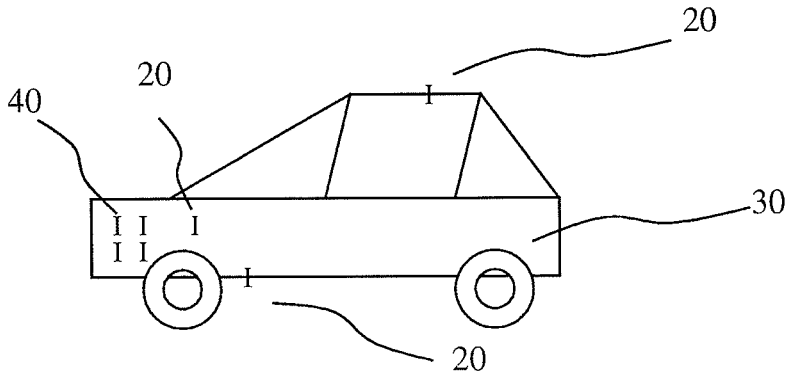
FIG. 13 shows an embodiment of a vehicle having an array of antenna elements divided into a cluster and satellite locations on the vehicle.

FIGS. 12, 13, System Views

FIG. 12 shows an example of a radar system having a transmit antenna 80 driven by a transmitter driver 85, fed by a local oscillator 100. Transmissions illuminate objects 70 and reflections are received by a receive antenna 90. This feeds receiver circuitry 95 which in turn feeds a demodulator 110. This can make use of a local oscillator signal which be related to the oscillator used for the transmitter, or be independent. These parts 85 and 95 can use conventional circuitry to handle phase and amplitude and process these components to modulate or demodulate, adapted to the particular antenna element spacings used.

The positioning of the antenna elements of a tiling may be spread across a vehicle such as a car, and an example is shown in FIG. 13. This shows a car 30, a cluster of closely spaced elements 40, and a number of more spaced apart elements 20. The Fibonacci Tiling antenna elements are placed along the corners of the tiling squares discussed above. Depending on the scale of the base length (here 0.4 mm for example) and depending on the antenna production technology, the antenna elements can be divided into two or more categories: a Cluster part and one or more Satellite parts as shown in FIG. 13 for example.

The cluster part is around the point where the Fibonacci iteration started. Here there are antenna elements placed very close to each other. The first 8 to 20 antenna elements can be united on one single substrate using a common lens for all the antenna elements. The remaining antenna elements form the satellite parts. These parts are comparably far away from the cluster unit and these individual antenna elements can be placed at will on the vehicle. Interaction and data transfer to the satellites would be done using optical fibers for example as no THz signal can be transported this far in the electrical domain without massive losses.

Depending on the actual type of antenna and frequency, a smaller or larger part of the antenna elements can be part of the Cluster. Since the distance from the cluster increases as the Fibonacci numbers increase, a large fraction of the aperture area is virtually empty. This can facilitate placement of the antenna elements on a vehicle, where a large number of areas cannot be used as antenna element positions.

The signal to noise ratio is much worse in a Fibonacci array compared to the filled case as long as identical antenna elements are used in both cases. The choice of antenna type in a classical, filled array is mostly determined by low cost and by a very small outer antenna dimension. Fibonacci arrays are sparse so more effective antenna elements are used. Using these, the signal to noise ratio can be made to the same level as in the filled case with a tremendous cost reduction.

The spatial resolution on the object is not affected. There is a slight detrimental effect caused by higher shoulders of the Fibonacci beams compared to filled beams which reduces contrast of the obtained image.

Since the shoulders of the beams are larger, the integration over snow and rain damping involves a larger area effectively reducing the influence of rain and snow damping. In the end, the above contrast loss is balanced out by the increased rain and snow capability.

It should be noted that any 2D array (of a given basis element distance) contains all distances corresponding to all Fibonacci numbers times a characteristic length when projected with respect to an arbitrary direction of incidence. The projected characteristic length is then given by the longer of the projection of the characteristic length vectors (in both coordinate directions given by the first seed square on the 2D array) with respect to the direction of incidence. Therefore a 2D array has the same reconstruction properties as a 1D array for all directions of incidence.

From this a number of propositions can be derived:

a): it is not associated with a loss of generality to refer to a 1D array since as mentioned elsewhere any 2D array appears as a 1D array when projected under a given direction of arrival.

b): A 1D array serves as a tool to extract target directions located in a plane that contains the baseline of the 1D array since we obtain all required phase difference measurements that allow the direction vector to be solved for. This solution is unique if and only if the projection of the 1D array base square size with respect to the direction of arrival vector is smaller than half a wavelength.

c: Consequently a 2D array is merely an extension of a 1D array where the target direction extraction is needed for arbitrary directions in 3D, resulting in a unique solution if and only if the projection of the 1D array base square size with respect to the direction of arrival vector is smaller than half a wavelength.

It is also noteworthy that:

1: a 2D array should have at least 7 antennas or groups of antennas to be assured of giving a distinct result compared to periodic arrays whereas a 1D array can have at least 4 antennas or groups of antennas.

2: that for a given frequency (and therefore wavelength) the direction retrieval yields an unique solution only if the base length of the seed square (2D array) [the seed line (1D array)] must be smaller than half a wavelength (being the longest possible baseline upon projection) which is the known rule for the avoidance of grating lobes in an array.

Other variations can be envisaged within the scope of the claims.

The invention claimed is:

1. An antenna having a one dimensional or multidimensional array of elements or groups of elements, wherein spacings between successive elements or successive groups of elements in at least part of the array are non periodic and correspond to a series of multiples of a unit spacing, wherein at least four successive multiples in the series of multiples follow a Fibonacci sequence.

2. The antenna of claim 1, wherein the at least four successive multiples in the series of multiples follow successive members of the Fibonacci sequence.

3. The antenna of claim 1 wherein the spacings comprise spacings between successive elements, or spacings between boundaries of successive groups of elements.

4. The antenna of claim 1, wherein the spacings comprise spacings within a group between opposing boundaries of the group for groups formed of elements spaced apart at corners of the group.

5. The antenna of claim 4, having a two dimensional array and wherein the spacings corresponding to the sequence occur along a line following a spiral.

6. The antenna of claim 5, arranged as a two dimensional Fibonacci square tiling.

7. The antenna of claim 1, at least some of the elements having beam forming capability at submillimeter wavelengths.

8. The antenna of claim 1, at least some of the elements having dimensions greater than the unit spacing.

9. The antenna of claim 1, having a two dimensional array having two primary axes, and the spacings corresponding to the sequence occur along at least one of the primary axes.

10. The antenna of claim 9, wherein the spacings corresponding to the sequence occur along both of the primary axes.

11. The antenna of claim 1, wherein the unit spacing is chosen to be one over square root of 2 times a half wavelength.

12. The antenna of claim 1, having a one dimensional array and wherein the spacings corresponding to the sequence occur along the array.

13. The antenna of claim 1, arranged to be suitable for use with submillimeter wavelength signals.

14. The antenna of claim 13 arranged to have an aperture within a range of 200 to 800 mm.

15. A submillimeter radar system having the antenna of claim 1 as a transmit antenna or as a receive antenna.

16. A vehicle having the radar system of claim 15.

17. A method of manufacturing an antenna, the method having the preliminary step of determining spacings of elements of an antenna to form a one dimensional or multidimensional array of the elements or groups of elements, by determining a unit spacing according to a desired wavelength, and by determining spacings between successive elements or successive groups of elements in at least part of the array so as to be non periodic and to correspond to a series of multiples of a unit spacing, at least four of the successive multiples in the series of multiples following a Fibonacci sequence.

18. The method of claim 17 wherein the spacings comprise spacings between successive elements, or spacings between boundaries of successive groups of elements.

19. The method of claim 17, wherein the spacings comprise spacings within a group between opposing boundaries of the group for groups formed of elements spaced apart at corners of the group.

20. The method of claim 17, wherein the at least four successive multiples in the series of multiples follow successive members of the Fibonacci sequence.

* * * * *